United States Patent [19]

Gerard et al.

[11] Patent Number: 4,614,853

[45] Date of Patent: Sep. 30, 1986

[54] PERMANENT MAGNET STEAM GENERATOR

[76] Inventors: Frank Gerard; Frank J. Gerard, both of 12020 Brooknoll Rd., Kingsville, Md. 21087

[21] Appl. No.: 787,035

[22] Filed: Oct. 15, 1985

[51] Int. Cl.[4] ..... H05B 6/10

[52] U.S. Cl. ..... 219/10.51; 219/10.65; 219/10.49 R; 165/185

[58] Field of Search ..... 219/10.51, 10.49 R, 219/10.71, 10.79, 10.75, 10.65; 165/185, 179

[56] References Cited

U.S. PATENT DOCUMENTS

| | | | |
|---|---|---|---|
| 2,912,552 | 11/1959 | Baermann | 219/10.49 R |
| 3,147,802 | 9/1964 | Katz | 165/185 |
| 3,272,956 | 9/1966 | Baermann | 219/10.49 R |
| 4,390,352 | 6/1983 | Grün | 165/185 |
| 4,484,049 | 11/1984 | Ahner et al. | 219/10.51 |
| 4,511,777 | 4/1985 | Gerard | 219/10.51 |

*Primary Examiner*—Philip H. Leung
*Attorney, Agent, or Firm*—John F. McClellan, Sr.

[57] ABSTRACT

An improved magnetic thermal generator has axially aligned, spaced-apart shafts, each with an electric motor at the outer end and on each inner end a permanent cylindrical magnet rotor with alternate north-pole and south-pole disposition of magnets parallel to each other in a circle about the shaft axis. In the spacing between the inner ends of the shafts a boiler is axially affixed. The boiler is of steel, is cylindrical in cross-sectional shape, and has at each end a steel disk-shaped end closure on the outside of which is bolted a copper disk of the same size. Fixed to the copper disk and extending hermetically through the end closure are a plurality of copper heat sinks, with axially alternative larger and smaller diameters; preferably the copper heat sinks from the respective ends are coaxially disposed and terminate within the boiler adjacent to each other but not touching. A steam dome protrudes from the top of the boiler and water inlet, water vent to the steam dome and steam exhaust are provided for water to be heated and passed transversely through the boiler into the steam dome.

1 Claim, 4 Drawing Figures

PERMANENT MAGNET STEAM GENERATOR

FIELD OF THE INVENTION

This invention relates generally to rotary-magnet steam generation and particularly to improved apparatus for same.

BACKGROUND OF THE INVENTION

In the known art, the disclosure of the following U.S. patent pertaining to this invention:

4,511,777 to Frank Gerard, 4-16-85, disclosed a motor-driven rotor with permanent cylindrical magnets embedded parallel with the axis and with alternative north-south orientation. Adjacent an end of the rotor a copper heat absorbing plate had a plurality of heat sinks extending through a ferro-magnetic plate, with surprising results.

DETAILED DESCRIPTION

Figure 1:
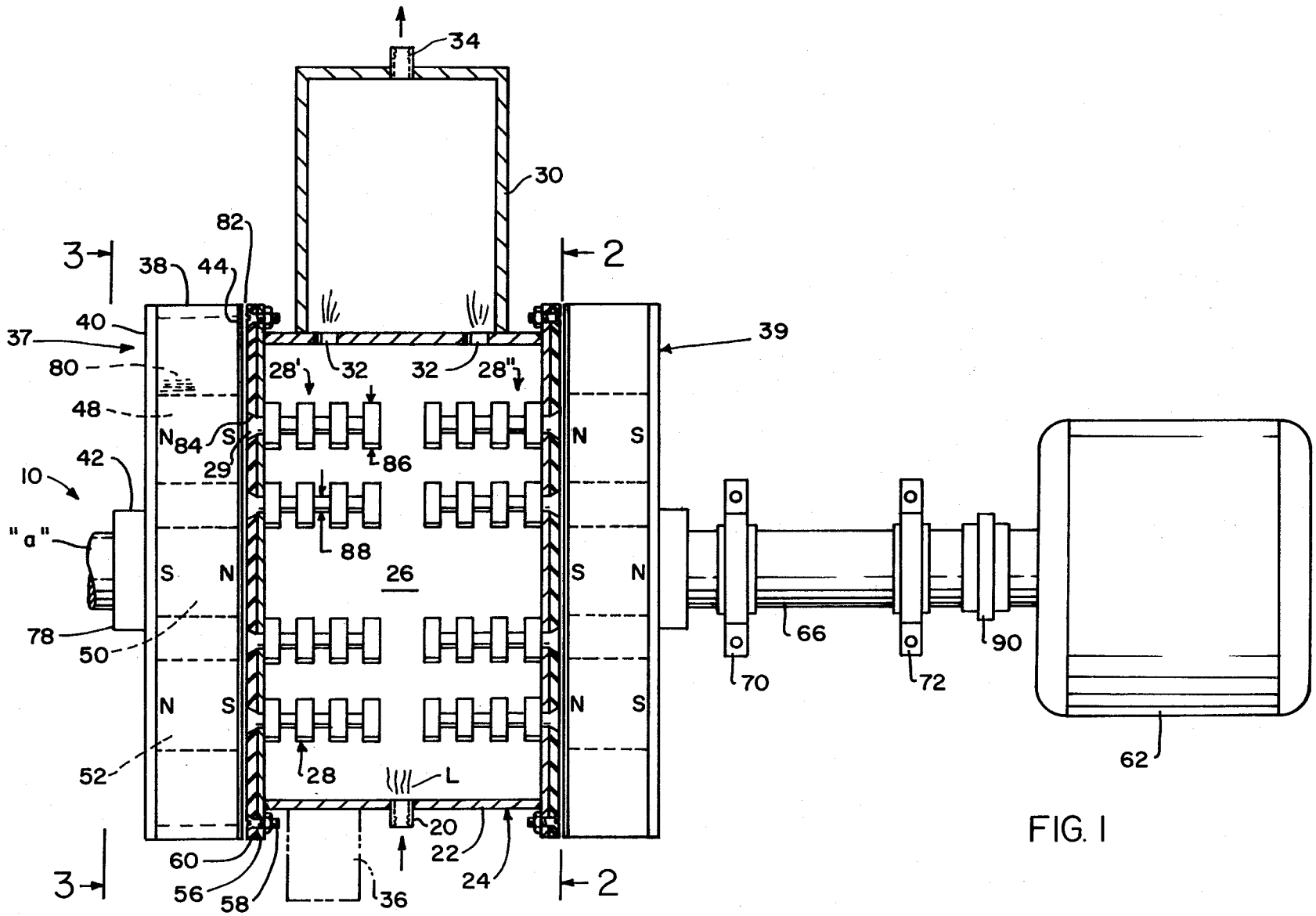
FIG. 1 is a fragmentary elevational view of the preferred embodiment of the invention.
Figure 1A:
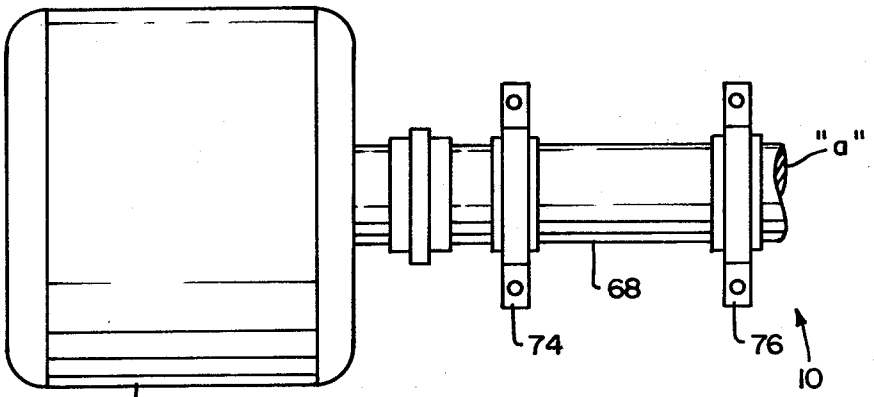
FIG. 1*a* is a similar view showing the remainder of the preferred embodiment.

FIGS. 1 and 1*a* for exposition are separated, when joined at "a" they show the preferred embodiment 10 of the invention in side elevational view.

Liquid L to be heated, which may be water, is passed through intake port or water inlet 20 fixed in the wall 22 of boiler cavity steel shell 24 into the boiler water cavity 26.

After being heated, primarily by contact with copper heat sinks 28 the liquid turns to steam and passes into steam-header steel shell 30 through steam header inlets 32 and out steam exhaust port 34, that like the intake port can be a threaded pipe nipple of similar conventional connector.

The steam may be used for heating or any other use desired. A conventional check valve, not shown, may be supplied to restrict back-flow of the feed water, if desired.

Any suitable support indicated at 36 but that is suitably massive and strong may be used to fix the boiler steel shell in place.

Heating is provided by apparatus that is in part like that disclosed in U.S. Pat. No. 4,511,777 issued to Frank Gerard, one of the present inventors, on 4-16-85, for PERMANENT MAGNET THERMAL ENERGY SYSTEMS. Each rotor 37, 39 of the present invention is the same, and the description of structure and function is incorporated herein. However, improvements have been made. In that patent an electric motor with shaft was located adjacent a plenum having a passage therethrough for heating air. A permanent-magnet rotor was fixed on the shaft. It included a disk-shaped housing held coaxially on the shaft by a hub and set screw.

The rotor housing comprised, as here shown in FIG. 1 an outer ring 38, a ferromagnetic backing plate 40, on a hub 42, a front plate 44 of stainless steel, and inside, high temperature type cement holding four (or any even number, depending on size) permanent magnets 48, 50, 52 (shown) parallel to the axis and equally spaced in a circular array around the axis.

The magnets were arranged alternately so that a first magnet, as for example 50, had a north pole adjacent the flat end of the boiler, the second magnet 52 had the south pole adjacent it, the third magnet had the north pole adjacent it and the fourth magnet had the south pole adjacent it. The relatively thin stainless steel plate covering the rotor face adjacent the boiler was in close spacing to, or touching the magnets, for compactness.

When the electric motor drive for the shaft was turned on, fluid introduced through one end of the plenum became heated and was discharged, as for example, hot air, the heat depending on speed of rotation. A plurality of laterally spaced copper heat sinks or plates attached through a steel backing plate to a copper front plate adjacent the rotor, projected into the plenum and heated, upon rotation of the rotor, the air passing through the plenum.

In the present invention, the embodiment 10 is preferably symmetrical about the transverse centerline passing through the fluid intake 20 and steam exhaust 34.

On each end of the member 24, a ferro-magnetic condensing plate 56 has attached to it by boiler housing bolts 58 a copper heat-absorbing plate 60 which is closely adjacent to one of the rotors 37, 39 that are driven for reliability and compact size by respective electric motors 62, 64 having output shafts 66, 68 mounted on bearings 70, 72, 74 76 (pillow blocks). Each rotor has the elements and arrangement described in relation to the referenced patent; outer ring and backing plate welded to it, and hub 78, all of steel. The magnets are embedded in furnace cement, fragment indicated at 80. As noted, the magnets are alternated in diposition between north and south, all in parallel with the shaft axis and spaced in a circle about it. The shaft may be of steel. A stainless steel plate closes off the end of each rotor, as indicated. Pillow blocks or other suitable bearings serve as the bearings to support the shaft coaxial with the boiler and the electric motors.

The flange or annular protrusion at each end of the boiler, made up of the rim of the copper heat absorbing plate and the ferro-magnetic condensing plate, makes it easy to join these plates by means of the boiler housing bolts, as indicated.

There is a minimal air gap 82 between each rotor and the respective adjacent copper heat absorbent plate.

The copper heat absorber plates 60 have in them tapered holes 84 that retain, as by brazing or upsetting of the ends 29, respective copper heat sinks 28.

The copper heat sinks extend through the ferro-magnetic condensing plates 56 and into the boiler water cavity 26 of the boiler cavity steel shell 24.

Copper heat sinks of the first array 28' of copper heat sinks 28 are preferably, for most efficient heating, coaxial with those of the second array 28" of copper heat sinks. Spacing between the inner ends of the two arrays is preferably minimal. They may almost, but not quite, touch.

Each copper heat sink 28 has, for efficient heat transfer, a coaxial cross-section of two diameters. The larger diameters 86 begin at the ferro-magnetic condensing plates and alternate with the smaller diameters 88. Transitions from small to large diameter are preferably radial. Turbulent flow without pockets but with uniformly good heat transfer is promoted by this structure.

The same surprising increase in efficiency disclosed in the referenced patent (4,511,777) will be found in the present invention also, it is believed, because of the relation of the copper structure to the steel structure, the copper heat absorber plate 60 being essentially integral with the heat sinks 28 that extend through the ferro-magnetic condensing plate 56.

FIG. 1*a* is a continuation of FIG. 1 and shows the shaft 68, bearings 74, 76 and electric motor 64 at the opposite end from FIG. 1.

Figure 2:
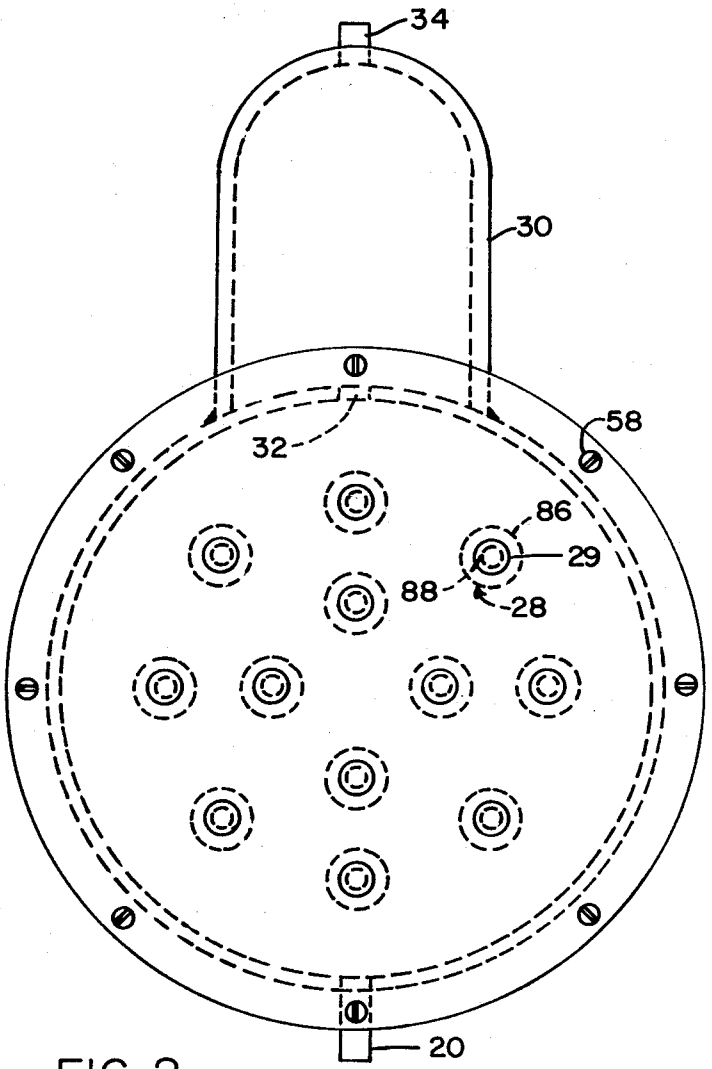
FIG. 2 is an end view taken at 2—2, FIG. 1.

FIG. 2, taken at 2—2, FIG. 1, shows the boiler header, steam header, or steam dome 30 with steam exhaust port 34, one of the steam emission ports 32, between it and the cylindrical wall, the upset ends 29 of the copper heat sinks 28 in the boiler cavity, the larger diameter portions 86 and smaller diameter portions 88 of the copper heat sinks, (these portions have equal length) the boiler housing flanges (one shown) and bolts 58 for same, and the water inlet 20.

Figure 3:
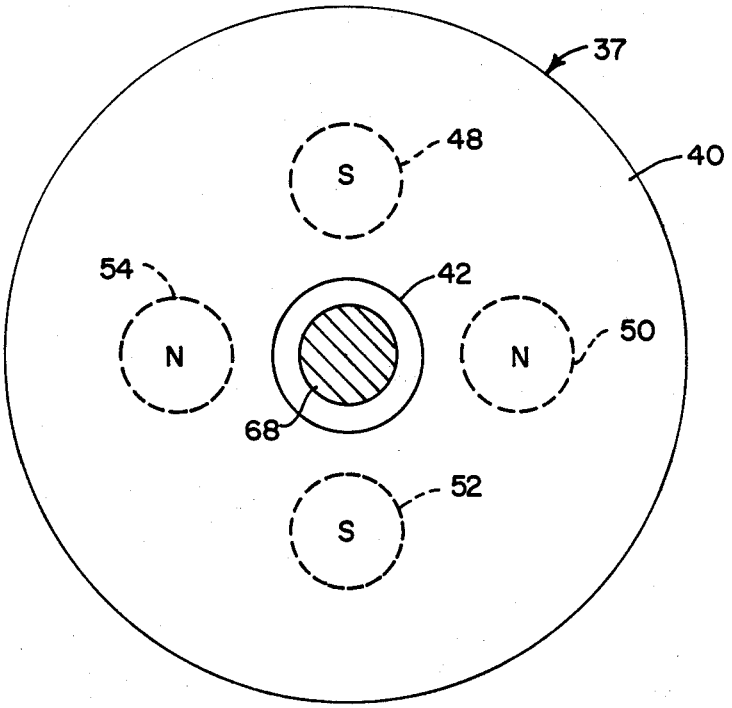
FIG. 3 is a partly sectional view taken at 3—3, FIG. 1.

FIG. 3, taken at 3—3, FIG. 1 shows in axial view a rotor 37 with backing plate 40, hub 42, magnets 48, 50, 52, 54 and shaft 68.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system for magnetic heating of a fluid by motor rotation of a permanent magnet rotor adjacent an assembly of ferro-magnetic condensing plate and of copper heat absorber plate with protrusions through the ferro-magnetic condensing plate into an enclosure with said fluid therein and having fluid inlet and fluid outlet, said assembly having a first shaft and a second shaft coaxially spaced therefrom, a respective said motor connected to the outer end of each shaft, and a respective said permanent magnet rotor connected to the inner end of each shaft, adjacent a said heat absorber plate, the improvement comprising: the enclosure including a steel boiler with a first said ferro-magnetic condensing plate closing off a first end thereof and a second said ferro-magnetic condensing plate closing off a second end thereof, a said copper heat absorbing plate affixed on each ferro-magnetic plate; means, free of pockets, for promoting turbulent flow of said fluid with uniformly good heat transfer including said protrusion being a plurality of heat sinks, each heat sink of said plurality of heat sinks comprising an integral elongate member with a plurality of alternately large diameter and smaller diameter portions regularly spaced therealong, said elongate members through the first said ferro-magnetic condensing plate being coaxially aligned with said elongate members through the second said ferro-magnetic condensing plate, and said elongate members through the first ferro-magnetic condensing plate being spaced apart from the elongate members through the second condensing plate.

* * * * *